US005407370A

United States Patent [19]

Lostumo

[11] Patent Number: 5,407,370

[45] Date of Patent: Apr. 18, 1995

[54] CRT ANODE CAP WITH THREE LEAD QUICK DISCONNECT

[75] Inventor: Arthur J. Lostumo, Franklin Park, Ill.

[73] Assignee: Zenith Electronics Corporation, Glenview, Ill.

[21] Appl. No.: 175,064

[22] Filed: Dec. 29, 1993

[51] Int. Cl.[6] ..... H01R 15/08

[52] U.S. Cl. ..... 439/854

[58] Field of Search ..... 439/86, 89, 507, 514, 439/909.1, 502, 854; 313/477 HC

[56] References Cited

U.S. PATENT DOCUMENTS

| | | | |
|---|---|---|---|
| 4,382,650 | 5/1983 | Herrmann, Jr. | 439/909.1 X |
| 4,742,267 | 5/1988 | Francis et al. | 313/477 HC |
| 4,865,559 | 9/1989 | Clabburn | 439/507 X |
| 4,894,023 | 1/1990 | Hall | 439/909.1 X |
| 4,969,825 | 11/1990 | Enomoto et al. | 439/514 X |
| 5,022,874 | 6/1991 | Lostumo | 439/724 |
| 5,096,445 | 3/1992 | Lostumo | 439/909.1 X |
| 5,196,764 | 3/1993 | Kim et al. | 313/477 HC |

*Primary Examiner*—David L. Pirlot
*Assistant Examiner*—Daniel Wittels
*Attorney, Agent, or Firm*—Roland W. Norris

[57] ABSTRACT

In a projection television display having three CRTs, the anode voltage wiring is simplified and made more economical by providing one CRT with a first anode button having voltage takeoffs for the other two CRT anode caps. The wire connections in the first anode cap allow for quick, tool free connection and disconnection of the wires.

16 Claims, 3 Drawing Sheets

CRT ANODE CAP WITH THREE LEAD QUICK DISCONNECT

BACKGROUND OF THE INVENTION

The present invention relates to anode connections for cathode ray tubes (CRTs). The present invention relates specifically to an anode cap especially constructed for ganging a plurality of CRTs with the same anode voltage.

As seen in FIG. 1, in a known display utilizing a plurality of CRTs, such as a projection display having three monochromatic primary colored CRTs, a great deal of wiring is used in getting the operating voltage for the CRT from the sweep transformer 11 to the focus control block 13 to the anode cap 12 of each CRT. From the focus control block separate wire leads 14, 16 and 18 respectively are connected to each of the first through third CRTs 15, 17 and 19 respectively. Thus, in the known method of wiring the CRTs to the anode voltage a great deal of expensive high voltage wire is consumed.

It is an object of the present invention to reduce the usage of wires for ganging multiple CRTs. It is another object of the invention to provide for a quick, i.e., tooless, disconnect of the CRT anode voltage lines.

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DETAILED DESCRIPTION OF THE PREFERRED EMBODIMENT

Figure 1:
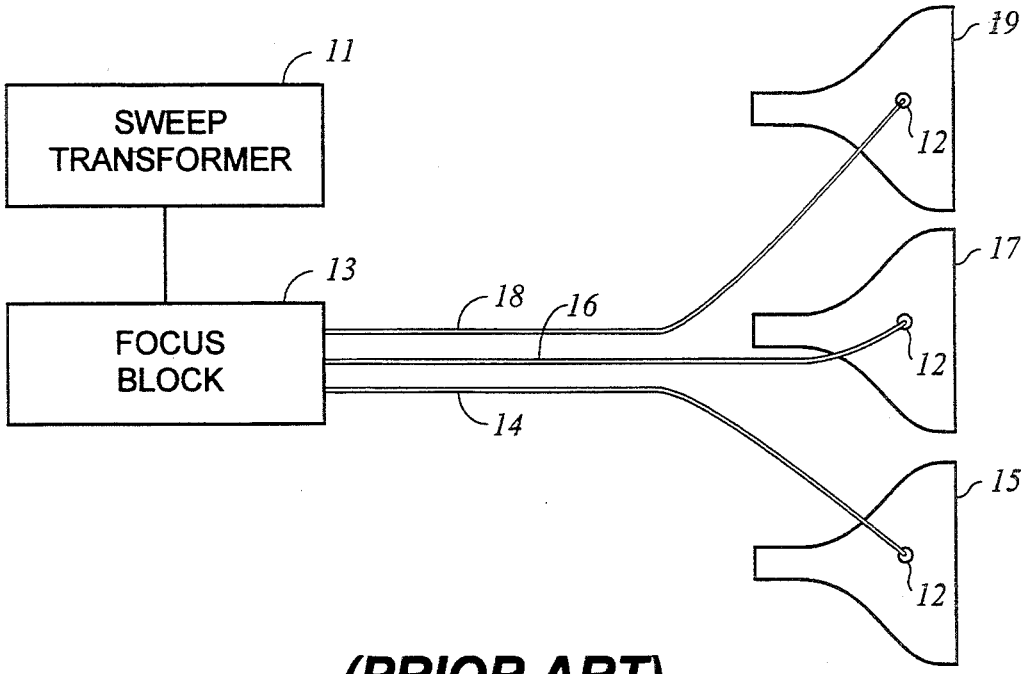
(PRIOR ART) Fig. 1
FIG. 1 shows a known method of connecting the multiple CRTs of a display projection television to a single anode voltage.
Figure 2:
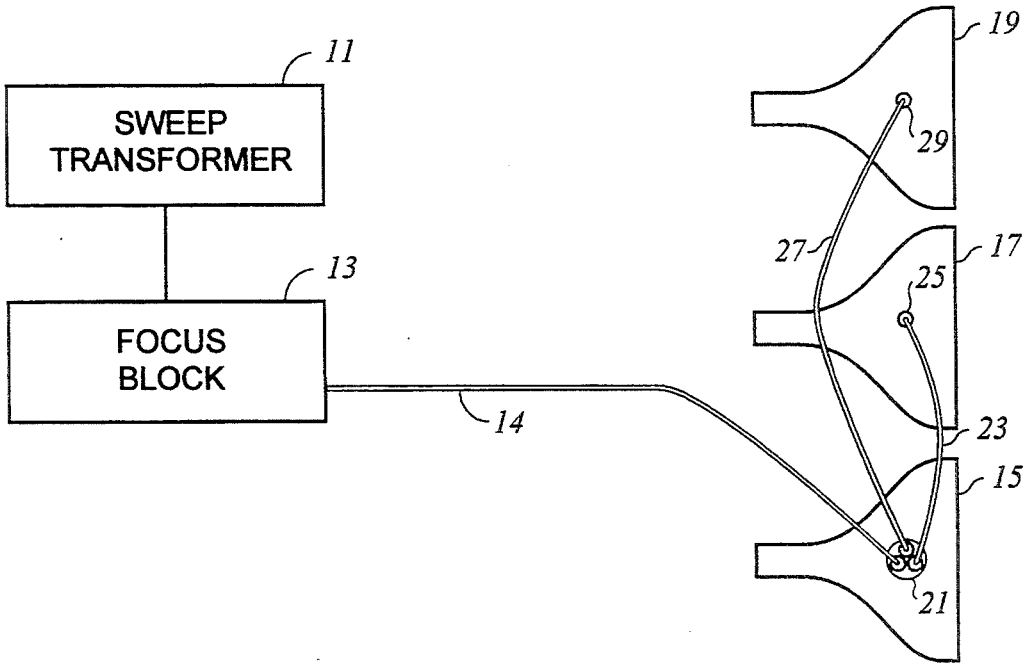
FIG. 2 is a schematic view of a way of connecting multiple CRTs to the same anode voltage according to the present invention.

As seen in the embodiment of the present invention of FIG. 2, the CRTs are ganged differently than in the prior art. The sweep transformer 11 feeds the focus block 13. The focus block 13 then feeds the first CRT 15 with a first wire lead 14. However, unlike the prior art, the first CRT 15 has an anode cap 21 with a three lead disconnect feature as further explained below. From the three lead anode cap 21, the second CRT 17 is supplied with anode voltage by a wire 23 connected between the three lead anode cap 21, and the second CRT single lead anode cap 25. The third CRT 19 is connected in a similar manner by a wire 27 extending from the three lead anode cap 21 to the third CRT anode cap 29.

Figure 3:
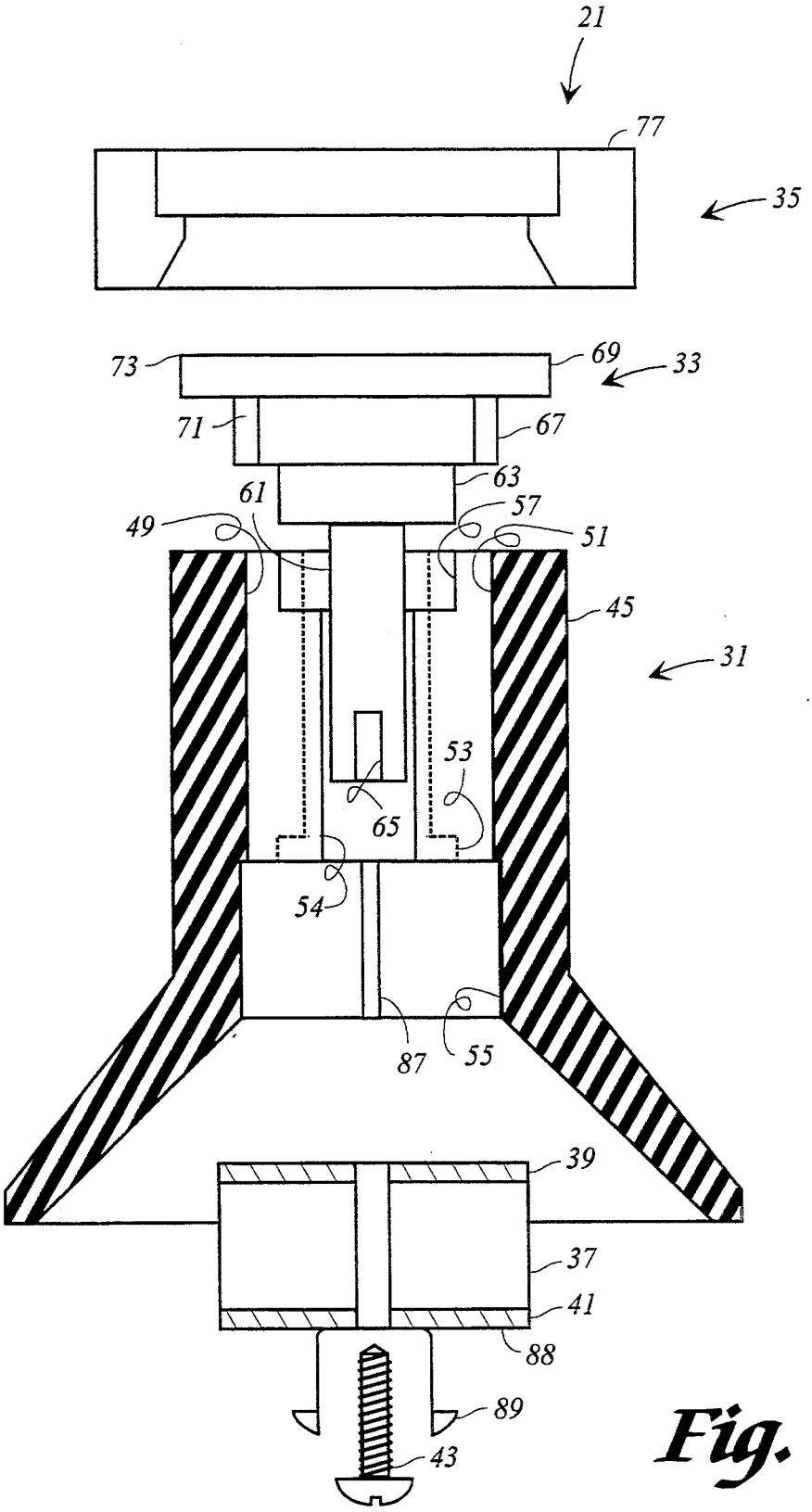
FIG. 3 is a side view and cross section of a CRT anode cap with the three lead quick disconnect according to the present invention.

As seen in FIG. 3, the three lead anode cap 21 essentially comprises a nonconductive silicone rubber cover 31, a center post 33, a twist cap 35, a conductive rubber pad 37, a metal plate 39, an anode clip 41, and a screw 43.

Figure 4:
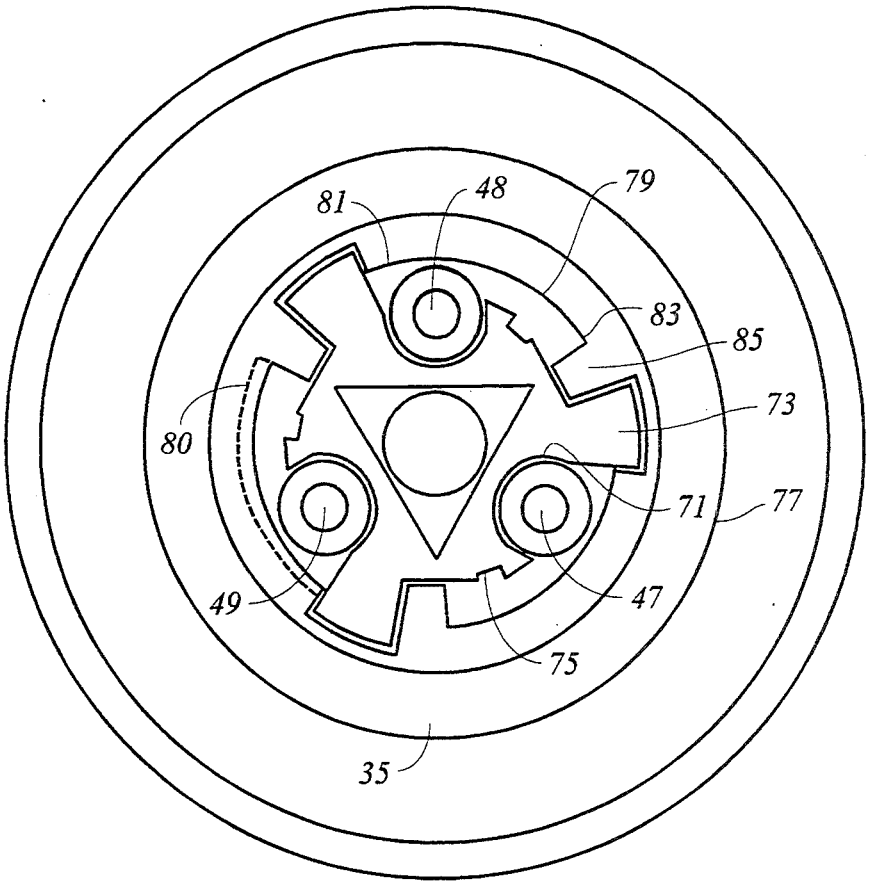
FIG. 4 is a top view of the three lead anode cap as shown in the embodiment of FIG. 3.

The nonconductive cover 31 includes a barrel portion 45 and a cup section 47. These sections are contiguous as in an ordinary one lead anode protective covering. The barrel section 45 has, as best seen in FIG. 4, three wire channels 48, 49 and 50 located radially equidistance therein and sized so as to accept the insulation of the inserted wire in a snug fitting, preferably air tight, relationship. The wire channels 48, 49 and 50 have a first insulation diameter bore 51 for accepting the insulation as previously mentioned and a smaller diameter wire bore 53, thus helping to insure that the insulation will form a tight seal against the barrel 45 at the inner terminus of the insulation bore 51. Wire bore 53, of course, allows the conductive portion of the lead, i.e., the wire, to communicate through the metal plate 39 having throughholes therein and into the common conductive substrate which is a the conductive rubber pad 37. The barrel portion 45, of course, has a cavity 55 therein for receiving the conductive rubber pad 37. The barrel walls forming the cavity 55 are ribbed so as to secure the placement of the conductive rubber pad and metal plate 39 in their properly oriented positions. It will be appreciated that this cavity 55 is accessible through the cup 47 of the cover 31.

The barrel section 45 also contains a center bore 54 that is structured to snugly receive and maintain the center post 33. Accordingly, the center bore 54 has a first triangular key bore 57 and a second circular bore 59 communicating with the conductive rubber cavity 55.

The center post 33 comprises three major portions: a central shaft 61 at a first end thereof, a triangular post key portion 63, and a locking plate 69. The post key 63 and central shaft 61 fit within the barrel section 45. The central shaft has a bore therein for receiving the screw 43. Located at a second end away from the screw bore 65 and above the post key 63 is a standoff 67 crowned by the locking plate 69. The standoff 67 elevates the locking plate 69 above the surface of the barrel section 45. The locking plate 69 has semicircular cutouts 71 for receiving the anode voltage leads. The locking plate 69, further, has locking flanges 73 for operably communicating with the twist cap 35 and locking slots 75 also for communicating with the twist cap 35, as further explained below.

As best seen in FIG. 4, the twist cap 35 has a knurled outer rim section 77 and increasingly radiused arcuate flanges 79. The flanges 79 have a first short end 81 for fitting over the wire leads and a second long end 83 for engaging the insulation of the wire lead when the twist cap 35 is twisted, thereby securing the anode lead in place in the anode cap 21. The twist cap flanges 79 are designed to rotate beneath the locking plate flanges 73 and to be secured to the anode cap thereby when the twist cap is in its locked position. Terminating the second long end of the twist cap flanges is a locking flange 85 for communicating the locking slots 75 of the locking plate 69. The increasingly radiused arcuate flanges 79 preferably have an undercut or beveled edge 80 which meets the wire insulation to provide a slip resistant edge.

The rubber cavity 54 has three radially equidistant ribs 87. These ribs help secure the conductive rubber pad 37 and the metal plate 39 in a fixed radial orientation by cooperating with circumferential grooves formed in the rubber pad and the metal plate. The conductive rubber pad 37 receives the conductive part of the high voltage lead and shorts all the wires together. The conductive part of the lead, i.e., the tinned wire, is sized so as not to penetrate through the conductive rubber pad, thus ensuring no air passages which might violate the integrity of the seal between the anode cap and the CRT. The metal plate 39 interposed between the conductive rubber pad and the wire channels of the barrel section is, of course, suitably perforated with three radially equidistant throughholes to permit the wire passage therethrough as well as having a center bore for receiving the screw 43. The anode clip 41 is then placed against the conductive rubber pad 37. The anode clip 41 includes a metal plate 88 for mechanical stability which has extending therefrom prongs 89 for contacting the anode button of the CRT funnel. The screw 43 passes through the anode clip 41, the conductive rubber pad 37, the metal plate 39 which is provided for mechanical stability and as a radiation shield, and threads into the center post 33, thus securing all principal parts of the anode cap together accept for the twist cap 35. It will be appreciated that all said principal members are press fit/snug fit so as to provide an air tight unit. The anode voltage leads, with insulation diameter matched to the circular bore of the insulation channel 59 and exposed conductive wire for penetrating the conductive pad, are inserted into the barrel section 45 and the twist cap 35 is then twisted to secure the flanges 79 thereof against the insulation of the leads, thus securing the leads within the anode cap unit while still providing for quick disconnect.

While the present invention has been illustrated and described in connection with the preferred embodiments, it is not to be limited to the particular structure shown, because many variations thereof will be evident to one skilled in the art and are intended to be encompassed in the present invention as set forth in the following claims.

What is claimed:

1. A CRT anode cap, comprising:

(A) a clip for electrically connecting with a CRT anode;

(B) means for electrically connecting the clip to a first anode voltage lead;

(C) means for electrically connecting a second anode voltage lead to the first anode voltage lead; and (D) means for securing the first and second anode voltage leads to the anode cap.

2. The anode cap according to claim 1 wherein the means for electrically connecting the clip to the anode lead comprises a conductive rubber pad electrically connected to the clip and capable of receiving the anode voltage lead.

3. The anode cap of claim 1 wherein the means for shorting a second lead to the anode voltage lead further comprises a conductive rubber pad capable of receiving the conductive parts of both leads.

4. The CRT anode cap according to claim 1 further comprising means for forming air tight seals between the anode cap and the anode voltage leads.

5. The CRT anode cap according to claim 1 further comprising: means for releasably securing the electrical leads to the anode cap without the use of tools.

6. The CRT anode cap according to claim 1 further comprising a flexible, insulative cap covering said clip.

7. An anode cap for a projection display CRT, comprising:

A) a nonconductive cover having:

1) a barrel with i) a plurality of anode lead channels for receiving anode leads, ii) a center bore for receiving a center post, iii) a cavity for receiving a conductive rubber pad, and 2) a cup section substantially conical, flexible and contiguous with the barrel;

B) a center post having:

1) a central shaft at a first end thereof for fitting into the center bore and having a screw receiving bore therein, 2) a stand off for holding a locking plate above a surface of the barrel section, 3) a locking plate having cutouts for receiving the anode leads and locking flanges thereon;

C) a twist cap having flanges for engaging the anode leads;

D) a conductive rubber pad fitting into the cavity of the barrel and having a screw-receiving center bore;

E) an anode clip contacting the conductive rubber pad and having a screw-receiving center bore;

F) a screw for interconnecting and securing the anode clip, the rubber pad and the center post together with the nonconductive cover.

8. An anode cap according to claim 7 wherein the anode lead channels further have bores closely approximating the diameter of the installation of anode voltage leads to be inserted therein and second bores smaller than said insulation bores for receiving the conductive portion of the anode leads.

9. The anode cap according to claim 7 wherein the center bore further has a key bore for receiving a keyed portion on the shaft of the center post for anchoring the center post in a fixed position within the barrel section.

10. An anode cap according to claim 7 wherein the cavity for receiving the conductive rubber pad has ribs on the cavity walls for holding the rubber pad and the rubber pad has grooves on its peripheral walls for mating with the ribs on the cavity walls.

11. The anode cap according to claim 7 wherein the twist cap flanges slide beneath the flanges of the locking plate.

12. The anode cap according to claim 7 wherein the twist cap flanges are increasingly radiused arcuate flanges which provide for gripping the insulation of the anode lead upon twisting of the twist cap.

13. The anode cap according to claim 7 wherein the twist cap flanges have an undercut edge adjacent the insulation of the anode lead.

14. The anode cap according to claim 7 further comprising a metal plate contacting the rubber pad and having a screw receiving center bore for providing mechanical stability and a radiation shield.

15. The anode cap according to claim 7 wherein the anode clip further includes a metal plate of substantially the same diameter as the conductive rubber pad.

16. A method of wiring anodes for CRTs in a projection television display comprising:

connecting a first wire from the anode voltage source to a first CRT anode button of the type as described in claim 1;

connecting a second wire from the first CRT anode cap to a second CRT anode cap;

connecting a third wire from the first CRT anode cap to the third CRT anode cap.

* * * * *